US005568918A

United States Patent [19]

Torisawa et al.

[11] Patent Number: 5,568,918

[45] **Date of Patent: *Oct. 29, 1996**

[54] SHEET FEEDING APPARATUS

[75] Inventors: Nobuyuki Torisawa; Toshihiko Yamada, both of Minami-ashigara, Japan

[73] Assignee: Fuji Photo Film Co., Ltd., Kanagawa, Japan

[ * ] Notice: the term of this patent shall not extend beyond the expiration date of Pat. No. 5,415,388.

[21] Appl. No.: 480,051

[22] Filed: Jun. 7, 1995

Related U.S. Application Data

[63] Continuation of Ser. No. 348,129, Nov. 28, 1994, abandoned, which is a continuation of Ser. No. 121,887, Sep. 17, 1993, Pat. No. 5,415,388.

[30] Foreign Application Priority Data

Sep. 24, 1992 [JP] Japan ..... 4-254653

[51] Int. Cl.[6] ..... B65H 3/40

[52] U.S. Cl. ..... 271/91; 271/106

[58] Field of Search ..... 271/91, 92, 104, 271/106, 20

[56] References Cited

U.S. PATENT DOCUMENTS

| | | | |
|---|---|---|---|
| 2,941,799 | 6/1960 | Reincke | 271/92 |
| 3,101,941 | 8/1963 | Reincke | 271/92 |
| 3,937,457 | 2/1976 | Schwebel | 271/92 |
| 5,083,763 | 1/1992 | Hartta | 271/106 X |
| 5,127,645 | 7/1992 | Torisawa | 271/106 |
| 5,137,268 | 8/1992 | Suya | 271/106 X |
| 5,156,387 | 10/1992 | Seto | 271/20 |
| 5,415,388 | 5/1995 | Torisawa et al. | 271/91 |

FOREIGN PATENT DOCUMENTS

| | | | |
|---|---|---|---|
| 1110126 | 2/1956 | France | 271/20 |
| 628696 | 11/1961 | Italy | 271/20 |
| 61-80736 | 5/1986 | Japan . | |
| 0033037 | 2/1990 | Japan | 271/91 |
| 3834 | 1/1991 | Japan | 271/106 |
| 1291257 | 2/1987 | U.S.S.R. | 271/20 |
| 1291258 | 2/1987 | U.S.S.R. | 271/20 |
| 1402394 | 6/1988 | U.S.S.R. | 271/91 |

*Primary Examiner*—H. Grant Skaggs
*Attorney, Agent, or Firm*—Sughrue, Mion, Zinn, Macpeak & Seas

[57] ABSTRACT

A sheet feeding apparatus has a pair of suction cups for attracting an uppermost one of stacked sheets, the suction cups being spaced from each other in a direction across the direction in which the sheet attracted by the suction cups is fed, a swinging mechanism for swinging the suction cups toward each other while the suction cups are attracting the sheet, and a flexing mechanism for forcibly flexing a portion of the sheet between the suction cups toward a next one of the stacked sheets when the suction cups are swung toward each other by the swinging mechanism.

19 Claims, 4 Drawing Sheets

SHEET FEEDING APPARATUS

This is a continuation of application Ser. No. 08/348,129 filed Nov. 28, 1994, now abandoned, which is a continuation of application Ser. No. 08/121,887 filed Sep. 17, 1993, now U.S. Pat. No. 5,415,388.

BACKGROUND OF THE INVENTION

1. Field of the Invention

The present invention relates to a sheet feeding apparatus for feeding sheets, one by one, from a stack of sheets.

2. Description of the Related Art

Sheet feeding apparatus are employed to feed sheets, one by one, from a stack of sheets such as photographic films stored in a supply magazine in order to supply the sheets to an exposure device, a developing device, or the like.

Such a sheet feeding apparatus generally has a plurality of suction cups that are pressed against a sheet to attract the sheet under a vacuum that is developed in the suction cups by a vacuum generator. When the suction cups are pressed against the sheet, however, the sheet tends to adhere to an underlying sheet. Therefore, a plurality of sheets are liable to be fed simultaneously from the supply magazine by the suction cups.

Various proposals have heretofore been made to prevent a plurality of sheets from being simultaneously fed by the suction cups of a sheet feeding apparatus. For example, Japanese laid-open utility model publication No. 61-80736 discloses a sheet feeding apparatus having two suction cups that are swingable in respective opposite directions to each other. When a sheet is attracted by the suction cups, the suction cups are swung to cause the attracted sheet to flex so that its central area is lifted or lowered, thereby separating any underlying sheet or sheets that may have stuck to the attracted sheet.

Since the two suction cups are angularly movable in the respective opposite directions, the sheet attracted to the suction cups is flexed into a relatively large curvature when the suction cups are swung. Consequently, when the attracted sheet is flexed, any underlying sheet or sheets that may have stuck to the attracted sheet often tend to flex with the attracted sheet, and remain stuck to the attracted sheet. The proposed sheet feeding apparatus thus fails to reliably prevent a plurality of sheets from being fed simultaneously from a supply magazine by the suction cups.

SUMMARY OF THE INVENTION

It is therefore an object of the present invention to provide a sheet feeding apparatus which is capable of attracting a sheet with at least two suction cups and has a simple arrangement for reliably and easily preventing a plurality of sheets from being fed simultaneously from a magazine.

According to the present invention, there is provided a sheet feeding apparatus comprising a pair of suction cups for attracting an uppermost one of stacked sheets, the suction cups being spaced from each other in a direction across the direction in which the sheet attracted by the suction cups is fed, a swinging mechanism for swinging the suction cups toward each other while the suction cups are attracting the sheet, and a flexing mechanism for forcibly flexing a portion of the sheet between the suction cups toward a next one of the stacked sheets when the suction cups are swung toward each other by the swinging mechanism.

When the suction cups with the uppermost sheet attracted thereto are swung toward each other, the attracted sheet is curved in a direction away from the next sheet. At this time, the portion of the sheet between the suction cups is forcibly flexed toward the next sheet by the flexing mechanism. The portions of the sheet that are held against respective confronting ends of the suction cups are positioned at boundaries between those sheet portions which are curved away from the next sheet and the sheet portion which is forcibly flexed toward the next sheet. Since these portions of the sheet at the boundaries are sharply bent, the next sheet is reliably and easily separated from, and hence is prevented from adhering to, the sheet that is attracted by the suction cups. The sheet feeding apparatus can thus reliably prevent a plurality of sheets from being fed simultaneously.

According to the present invention, there is alsoprovided a sheet feeding apparatus comprising a pair of suction cups spaced from each other for attracting an uppermost one of stacked sheets, swinging means for swinging the suction cups in opposite directions, respectively, to curve the sheet attracted thereto into an upwardly convex shape, and flexing means for forcibly flexing a portion of the sheet between the suction cups downwardly toward the stacked sheets when the sheet attracted to the suction cups is curved into the upwardly convex shape.

The above and other objects, features, and advantages of the present invention will become apparent from the following description when taken in conjunction with the accompanying drawings which illustrate a preferred embodiment of the present invention by way of example.

DETAILED DESCRIPTION OF THE PREFERRED EMBODIMENT

Figure 1:
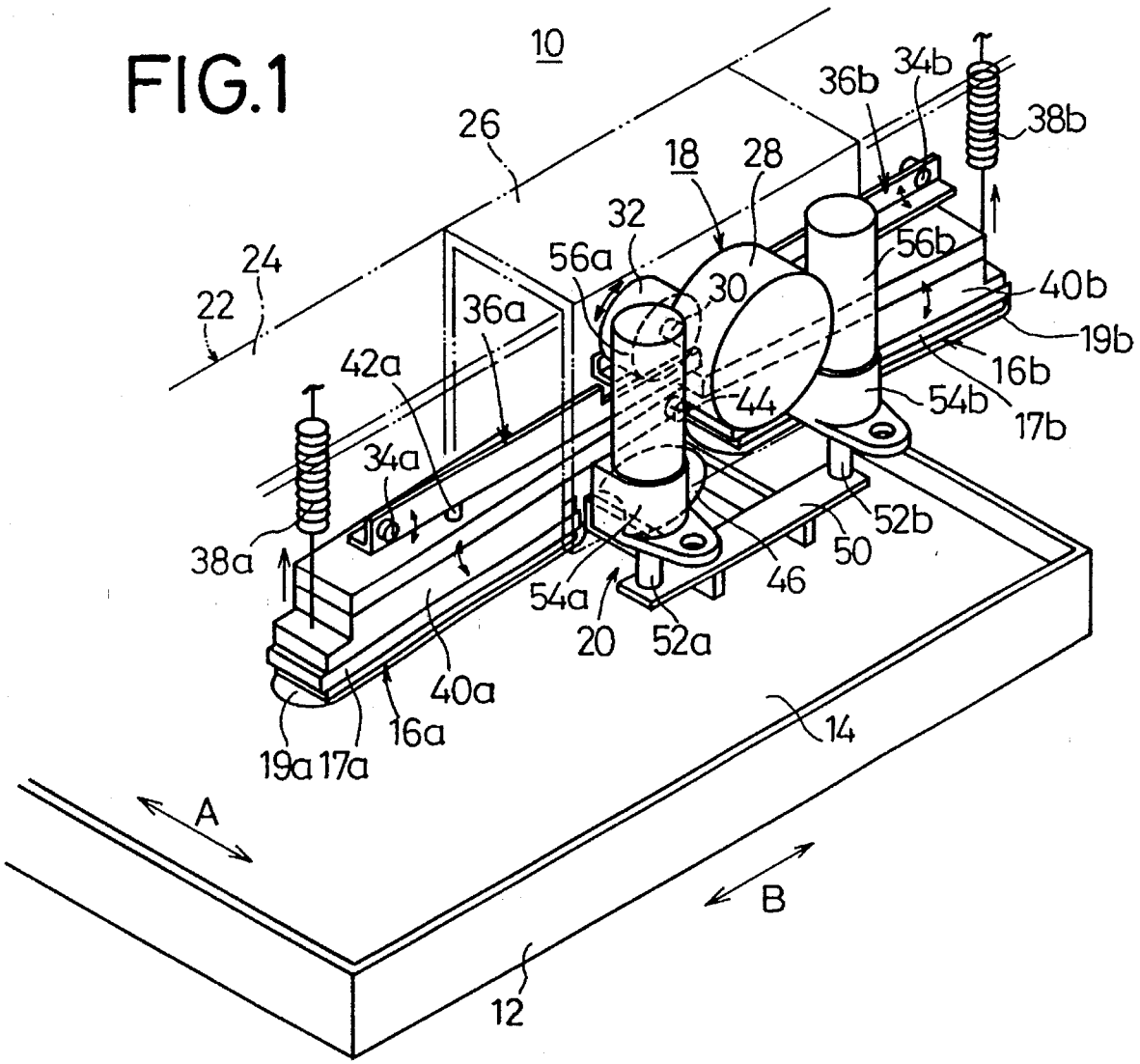
FIG. 1 is a perspective view of a sheet feeding apparatus according to the present invention.
Figure 2:
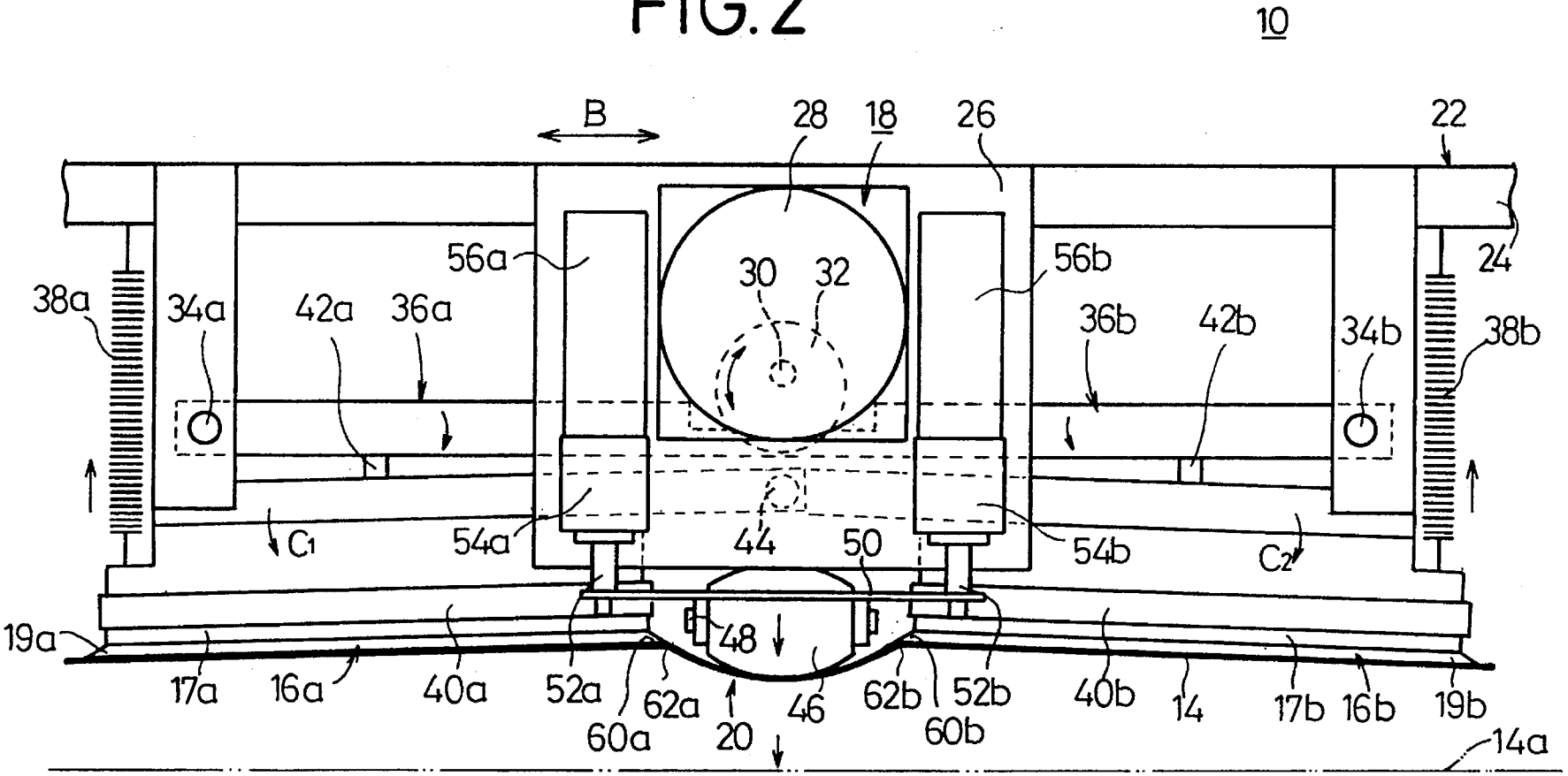
FIG. 2 is an enlarged front elevational view of the sheet feeding apparatus.
Figure 3:
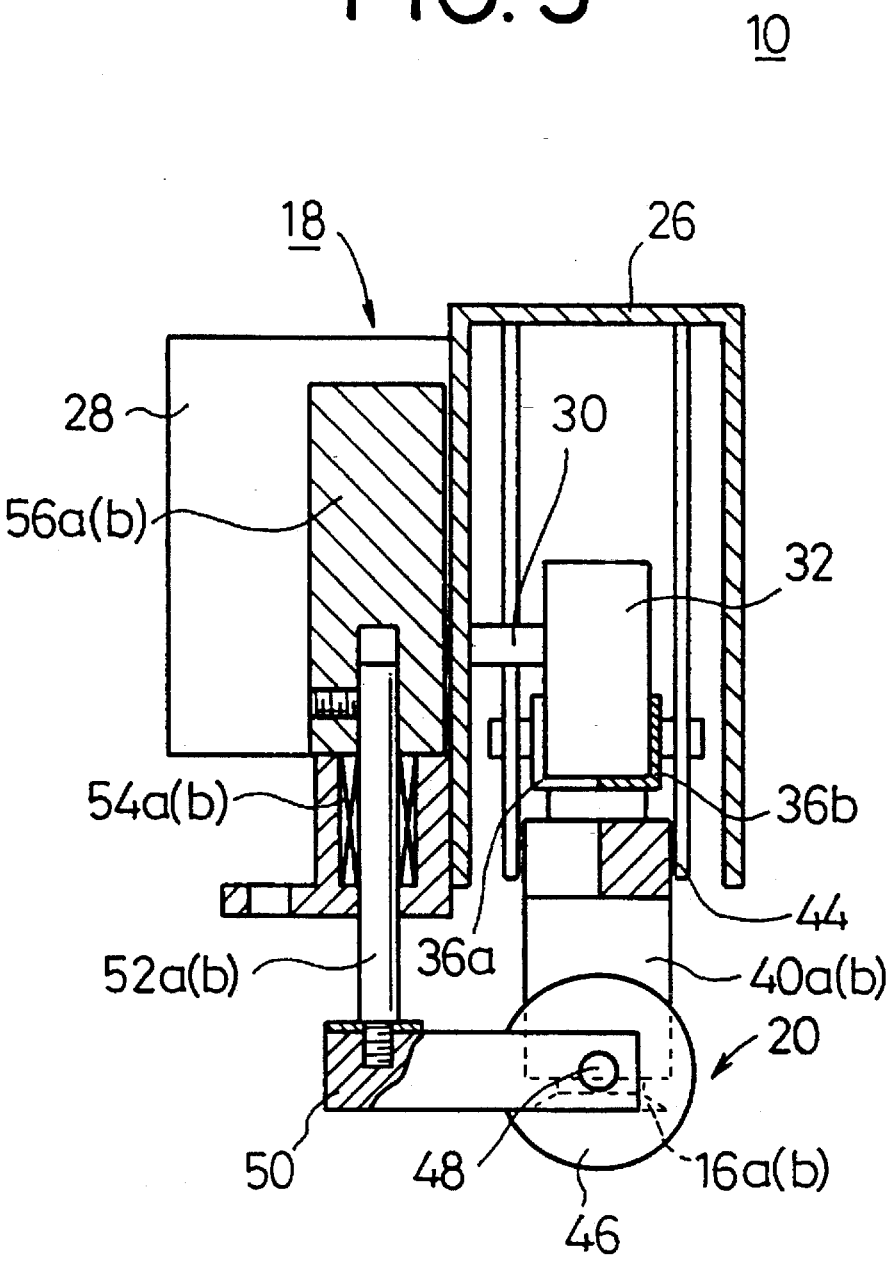
FIG. 3 is a vertical cross-sectional view of the sheet feeding apparatus.

As shown in FIGS. 1 through 3, a sheet feeding apparatus 10 according to the present invention has a pair of suction cups 16*a*, 16*b* for attracting a sheet 14 such as a photosensitive sheet from a stack of sheets stored in a magazine 12, the suction cups 16*a*, 16*b* being spaced from each other in the direction indicated by the arrow B across the direction indicated by the arrow A in which the sheet 14 is fed from the magazine 12. The sheet feeding apparatus 10 also includes a swinging mechanism 18 for swinging the suction cups 16*a*, 16*b* toward each other while they are attracting a sheet 14, and a flexing mechanism 20 for forcibly flexing a portion of the sheet 14 between the suction cups 16*a*, 16*b* downwardly toward a next underlying sheet 14*a* of the sheet stack when the suction cups 16*a*, 16*b* swing toward each other.

The suction cups 16*a*, 16*b* are elongate in the direction B and comprise respective flexible bases 17*a*, 17*b* each substantially in the shape of a rectangular parallelepiped, and respective flexible flaring skirts 19*a*, 19*b* joined to and positioned beneath the respective flexible bases 17*a*, 17*b*. The suction cups 16*a*, 16*b* are vertically movable toward and away from the magazine 12 by a displacing mechanism 22. The bases 17*a*, 17*b* may have corrugated bottoms to which the skirts 19*a*, 19*b* are joined. The displacing mechanism 22 has a support 24 that is vertically movable by an actuator (not shown), and a bracket 26 fixed to the support 24.

The swinging mechanism 18 comprises a rotary actuator 28 such as an electric motor fixedly mounted on the bracket 26, an eccentric cam 32 coupled to a rotatable shaft 30 of the rotary actuator 28, a pair of swing arms 36*a*, 36*b* having ends swingably supported on the support 24 by respective pivot shafts 34*a*, 34*b* and opposite ends engaging the eccentric cam 32, and a pair of holders 40*a*, 40*b* swingable toward each other in response to swinging movement of the swing arms 36*a*, 36*b*. The holders 40*a*, 40*b* lie generally horizontally under the bias of tension springs 38*a*, 38*b* connected between the holders 40*a*, 40*b* and the support 24. The suction cups 16*a*, 16*b*, i.e., the bases 17*a*, 17*b* thereof, are mounted on the respective holders 40*a*, 40*b*. The swing arms 36*a*, 36*b* have respective downwardly projecting pins 42*a*, 42*b* on their lower surfaces, respectively. The pins 42*a*, 42*b* engage respective upper surfaces of the holders 40*a*, 40*b*, which are swingably supported on a substantially central portion of the bracket 26 by a common pivot shaft 44.

The flexing mechanism 20 has a roller 46 vertically movably disposed between the suction cups 16*a*, 16*b* and normally biased to move downwardly toward the stacked sheets 14 in the magazine 12. The roller 46 has a substantially elliptical axial cross-sectional shape, and is supported on a rotatable shaft 48 that is mounted on an attachment 50 to which the lower ends of vertically extending shafts 52*a*, 52*b* are fixed. The shafts 52*a*, 52*b* are vertically movably guided by respective bearings 54*a*, 54*b* mounted on the bracket 26. Weights 56*a*, 56*b* are attached to the upper ends, respectively, of the shafts 52*a*, 52*b* for normally biasing the roller 46 to move downwardly.

Operation of the sheet feeding apparatus 10 will be described below.

Figure 4A:
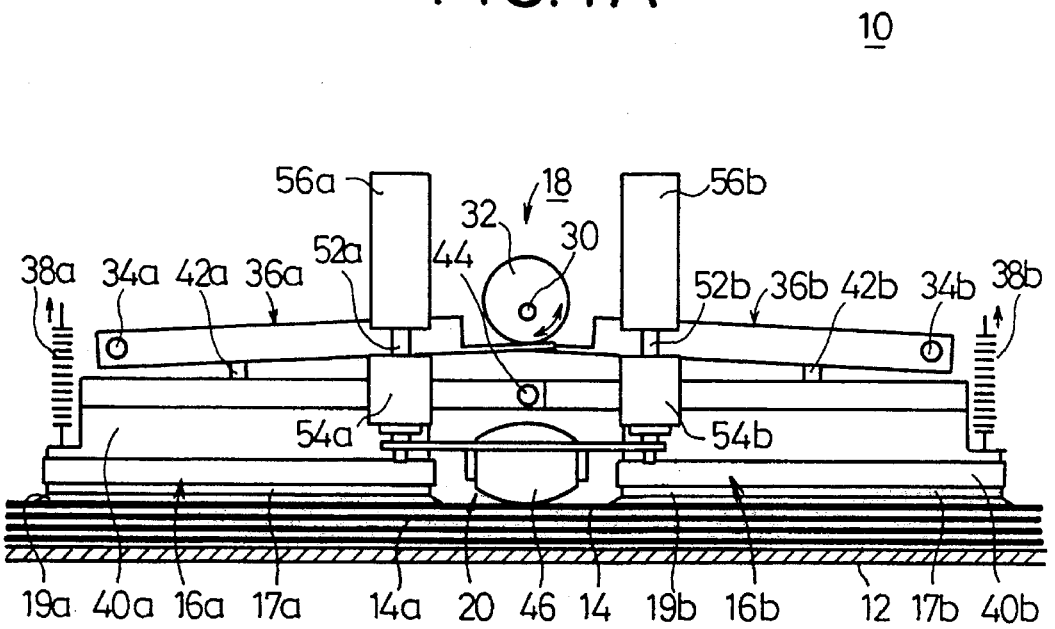
FIG. 4A is a front elevational view showing the manner in which the sheet feeding apparatus operates with suction cups held against an uppermost one of stacked sheets.

After the magazine 12 with a stack of sheets 14 stored therein is loaded into the sheet feeding apparatus 10, the actuator of the displacing mechanism 22 is operated to displace the support 24 and the bracket 26 downwardly toward the magazine 12. The roller 46 of the flexing mechanism 20 is brought into abutment against the uppermost sheet 14 in the magazine 12, and then the suction cups 16*a*, 16*b* abuts against the uppermost sheet 14 (see FIG. 4A).

Now, a vacuum is developed in the suction cups 16*a*, 16*b* by a vacuum generator (not shown) connected to the suction cups 16*a*, 16*b* for attracting the uppermost sheet 14 against the suction cups 16*a*, 16*b*. Then, the bracket 26 is lifted by the displacing mechanism 22, and the rotary actuator 28 of the swinging mechanism 18 is energized. The eccentric cam 32 is rotated by the rotary actuator 28 through the shaft 30 thereof, bringing a larger-diameter cam lobe thereof downwardly into engagement with the opposite ends of the swing arms 36*a*, 36*b*. Therefore, the swing arms 36*a*, 36*b* are angularly moved downwardly about the respective pivot shafts 34*a*, 34*b*, causing the pins 42*a*, 42*b* to push the respective holders 40*a*, 40*b* downwardly.

When pushed by the pins 42*a*, 42*b*, the holders 40*a*, 40*b* are angularly moved toward each other about the pivot shaft 44 in the respective directions indicated by the arrows C1, C2 in FIG. 2 against the tension of the tension springs 38*a*, 38*b*. Therefore, the suction cups 16*a*, 16*b* swing with the respective holders 40*a*, 40*b*, whereupon the uppermost sheet 14 attracted by the suction cups 16*a*, 16*b* is flexed or curved into an upwardly convex shape as a whole.

Figure 4B:
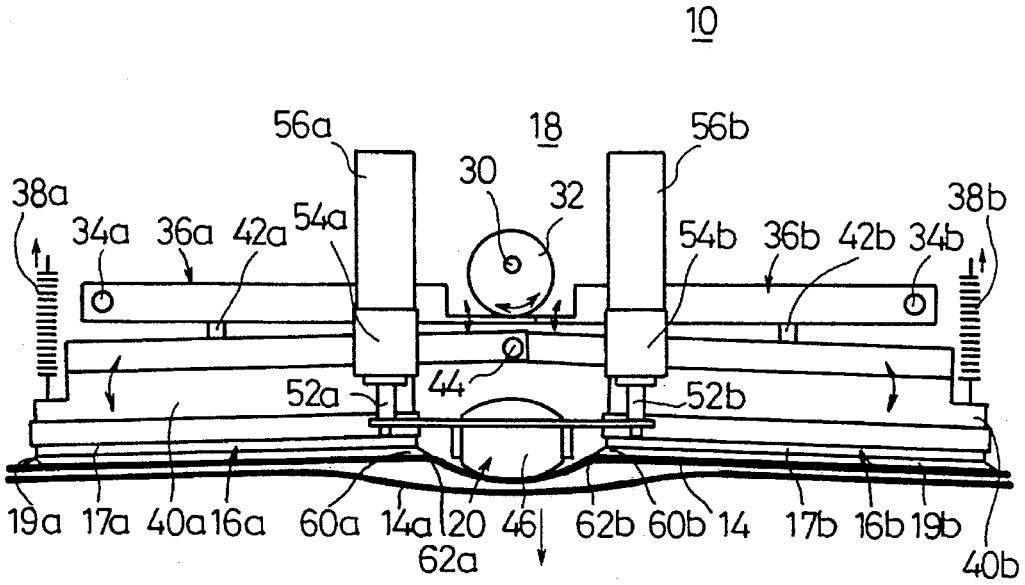
FIG. 4B is a front elevational view showing the manner in which the sheet feeding apparatus operates with the suction cups swung while attracting the uppermost sheet.

As the suction cups 16*a*, 16*b* swing toward each other, the distance between confronting ends 60*a*, 60*b* of the suction cups 16*a*, 16*b* is reduced (see FIG. 4B). Therefore, the portion of the sheet 14 between the confronting ends 60*a*, 60*b* is slackened and bends either upwardly or downwardly. When the bracket 26 is elevated, however, the roller 46 positioned between the suction cups 16*a*, 16*b* is biased downwardly by the weights 56*a*, 56*b*, pushing the slackened portion of the sheet 14 between the confronting ends 60*a*, 60*b* downwardly. Therefore, when the holders 40*a*, 40*b* are angularly moved, the slackened portion of the sheet 14 between the confronting ends 60*a*, 60*b* is forcibly flexed downwardly by the roller 46 that is biased to move downwardly. Since the slackened portion of the sheet 14 which is curved into an upwardly convex shape as a whole is flexed downwardly, portions 62*a*, 62*b* of the sheet 14 near the respective ends 60*a*, 60*b* of the suction cups 16*a*, 16*b* have their radius of curvature reduced (see FIGS. 2 and 4B). Consequently, a next underlying sheet 14*a* does not adhere to the sheet 14 that is attracted to the suction cups 16*a*, 16*b*, and is reliably and easily separated from the sheet 14. The sheet feeding apparatus 10 can thus prevent a plurality of sheets from being fed simultaneously from the magazine 12 with a simple arrangement including the roller 46.

The roller 46 is normally urged downwardly by the weights 56*a*, 56*b*, pressing the portion of the sheet 14 between the suction cups 16*a*, 16*b* downwardly. As a result, when the sheet 14 is taken out of the magazine 12, the next underlying sheet 14*a* is pressed downwardly by the roller 46 and returned to the magazine 12, so that the next underlying sheet 14*a* is further reliably prevented from being fed with the uppermost sheet 14.

When the larger-diameter cam lobe of the eccentric cam 32 is turned upwardly, the holders 40*a*, 40*b* are released from the downward push exerted by the swing arms 36*a*, 36*b* held in engagement with the eccentric cam 32. The holders 40*a*, 40*b* are now turned upwardly about the pivot shaft 44 into a horizontal position under the bias of the tension springs 38*a*, 38*b*. Thereafter, the sheet 14 attracted by the suction cups 16*a*, 16*b* is sent to a delivery device (not shown), which feeds the sheet 14 into an automatic developing apparatus or the like.

Although a certain preferred embodiment of the present invention has been shown and described in detail, it should be understood that various changes and modifications may be made therein without departing from the scope of the appended claims.

What is claimed is:

1. A sheet feeding apparatus comprising:

a pair of suction cups spaced from each other for attracting an uppermost sheet of stacked sheets;

a swinging mechanism for swinging said suction cups in opposite directions, respectively, to curve the uppermost sheet attracted thereto into an upwardly convex shape; and a flexing mechanism for forcibly flexing a portion of the uppermost sheet between said suction cups downwardly toward the stacked sheets when the uppermost sheet attracted to said suction cups is curved into the upwardly convex shape, wherein said flexing mechanism comprises:

a roller movably supported on a bracket between said suction cups; and a pair of weights coupled to said roller for normally biasing said roller toward said stacked sheets, said pair of weights being provided at respective sides of said roller such that each of said pair of weights imposes an equal bias on said roller.

2. The sheet feeding apparatus according to claim 1, further comprising a shaft and an attachment provided on an end of said shaft, and wherein at least one of said weights is connected to said shaft and said roller is rotatively mounted on said attachment.

3. The sheet feeding apparatus according to claim 2, wherein said shaft is vertically displaceable on a bearing mounted on said bracket.

4. The sheet feeding apparatus according to claim 3, wherein each of said pair of weights has a columnar shape.

5. The sheet feeding apparatus according to claim 2, wherein each of said pair of weights has a columnar shape.

6. The sheet feeding apparatus according to claim 1, wherein each of said pair of weights has a columnar shape.

7. A sheet feeding apparatus comprising:

a pair of suction cups spaced from each other for attracting an uppermost sheet of stacked sheets;

a swinging mechanism for swinging said suction cups in opposite directions, respectively, to curve the uppermost sheet attracted thereto into an upwardly convex shape; and a flexing mechanism for forcibly flexing a portion of the uppermost sheet between said suction cups downwardly toward the stacked sheets when the uppermost sheet attracted to said suction cups is curved into the upwardly convex shape, wherein said flexing mechanism comprises:

a roller for feeding the uppermost sheet in a feeding direction transverse to a line connecting the pair of suction cups, said roller being movably supported between said suction cups, and being normally biased toward said stacked sheets, and wherein an axis of rotation of said roller is traverse to the feeding direction.

8. The sheet feeding apparatus according to claim 7, further comprising a weight coupled to said roller for normally biasing said roller toward the stacked sheets.

9. A sheet feeding apparatus comprising:

a pair of suction cups spaced from each other for attracting an uppermost sheet of stacked sheets.

a swinging mechanism for swinging said suction cups in opposite directions, respectively, to curve the uppermost sheet attracted thereto into an upwardly convex shape; and a flexing mechanism for forcibly flexing a portion of the uppermost sheet between said suction cups downwardly toward the stacked sheets when the uppermost sheet attracted to said suction cups is curved into the upwardly convex shape, wherein said flexing mechanism comprises:

a roller for feeding the uppermost sheet, said roller being movably supported between said suction cups, and being normally biased toward said stacked sheets, further comprising a weight coupled to said roller for normally biasing said roller toward the stacked sheets, and wherein said weight comprises a pair of weights provided at respective sides of said roller such that each of said weights imposes an equal bias on said roller.

10. The sheet feeding apparatus according to claim 9, wherein each of said weights has a columnar shape.

11. The sheet apparatus according to claim 8, further comprising a shaft and an attachment provided on an end of said shaft, and wherein said weight is connected to said shaft and said roller is rotatively mounted on said attachment.

12. The sheet feeding apparatus according to claim 11, further comprising a bracket on which said roller is movably supported, and wherein said shaft is vertically displaceable on a bearing mounted on said bracket.

13. The sheet feeding apparatus according to claim 8, wherein said weight has a columnar shape.

14. A sheet feeding apparatus comprising:

a pair of suction cups spaced from each other for attracting an uppermost sheet of stacked sheets;

a swinging mechanism for swinging said suction cups in opposite directions, respectively, to curve the uppermost sheet attracted thereto into an upwardly convex shape; and a flexing mechanism for forcibly flexing a portion of the uppermost sheet between said suction cups downwardly toward the stacked sheets when the uppermost sheet attracted to said suction cups is curved into the upwardly convex shape, wherein said flexing mechanism comprises:

a bracket on which a roller for feeding the uppermost sheet in a feeding direction transverse to a line connecting the pair of suction cups is movably supported, wherein a shaft connected to said bracket is vertically displaceable on a bearing mounted on said bracket, and wherein an axis of rotation of said roller is transverse to the feeding direction.

15. The sheet feeding apparatus according to claim 14, further comprising a weight coupled to said roller for normally biasing said roller toward the stacked sheets.

16. A sheet feeding apparatus comprising:

a pair of suction cups spaced from each other for attracting an uppermost sheet of stacked sheets;

a swinging mechanism for swinging said suction cups in opposite directions, respectively, to curve the uppermost sheet attracted thereto into an upwardly convex shape; and a flexing mechanism for forcibly flexing a portion of the uppermost sheet between said suction cups downwardly toward the stacked sheets when the uppermost sheet attracted to said suction cups is curved into the upwardly convex shape, wherein said flexing mechanism comprises:

a bracket on which a roller for feeding the uppermost sheet in a feeding direction transverse to a line connecting the pair of suction cups is movably supported, wherein a shaft connected to said bracket is vertically displaceable on a bearing mounted on said bracket, wherein an axis of rotation of said roller is transverse to the feeding direction, further comprising a weight coupled to said roller for normally biasing said roller toward the stacked sheets, and wherein said weight comprises a pair of weights provided at respective sides of said roller such that each of said weights imposes an equal bias on said roller.

17. The sheet feeding apparatus according to claim 16, wherein each of said weights has a columnar shape.

18. The sheet apparatus according to claim 15, further comprising an attachment provided on an end of said shaft, and wherein said weight is connected to said shaft and said roller is rotatively mounted on said attachment.

19. The sheet feeding apparatus according to claim 15, wherein said weight has a columnar shape.

* * * * *